US007892041B2

(12) United States Patent
Myers et al.

(10) Patent No.: US 7,892,041 B2
(45) Date of Patent: Feb. 22, 2011

(54) AUDIO JACK WITH A TUBE WITH AN OPENING WITH A CONDUCTIVE DIMPLE TO CONTACT AN AUDIO PLUG

(75) Inventors: Scott Myers, San Francisco, CA (US); Bradley Hamel, Sunnyvale, CA (US); Erik Wang, Redwood City, CA (US); Jason Sloey, San Jose, CA (US); Richard Howarth, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/723,306

(22) Filed: Mar. 12, 2010

(65) Prior Publication Data

US 2010/0167595 A1 Jul. 1, 2010

Related U.S. Application Data

(63) Continuation of application No. 12/113,377, filed on May 1, 2008, now Pat. No. 7,708,604.

(51) Int. Cl.
*H01R 13/64* (2006.01)

(52) U.S. Cl. ..... 439/680

(58) Field of Classification Search ..... 439/680, 439/668, 669, 95, 544, 744
See application file for complete search history.

(56) References Cited

U.S. PATENT DOCUMENTS 4,867,708 A 9/1989 Iizuka
6,050,854 A 4/2000 Fang et al.
6,231,396 B1 5/2001 Huang
6,312,267 B1 11/2001 Wang
6,364,717 B1 4/2002 Lin
6,533,225 B1 3/2003 Berges et al.
7,034,225 B2 4/2006 Thompson et al.
7,371,084 B2 5/2008 Xue et al.
2007/0072488 A1 3/2007 Xue et al.
2007/0218774 A1 9/2007 Han et al.
2008/0032562 A1 2/2008 McHugh et al.
2008/0050977 A1 2/2008 Lee et al.
2008/0280499 A1 11/2008 Miki et al.
2009/0275243 A1 11/2009 Myers et al.

*Primary Examiner*—Chandrika Prasad
(74) *Attorney, Agent, or Firm*—Kramer Levin Naftalis & Frankel LLP

(57) ABSTRACT

A constraint mechanism for receiving an audio plug in an electronic device is provided. The constraint mechanism may include a conductive tube operative to receive the audio plug. In addition, the constraint mechanism may include several features operative to engage corresponding features of the electronic device to prevent the constraint mechanism from moving in any direction (e.g., which could cause damage in the electronic device if the audio jack was forced to move by an impact on the audio plug). For example, the constraint mechanism may include a center wall to prevent yawing, and rear tabs to prevent pitching. As another example, the constraint mechanism may include a side plate operative to be coupled to the electronic device to prevent rolling. In some embodiments, the constraint mechanism may include an asymmetrical tube entrance for ensuring the proper alignment of the constraint mechanism with an electronic device opening. The tube may include a conductive dimple extending through an aperture of the tube, where the aperture is substantially the same size and shape as the conductive dimple.

11 Claims, 11 Drawing Sheets

AUDIO JACK WITH A TUBE WITH AN OPENING WITH A CONDUCTIVE DIMPLE TO CONTACT AN AUDIO PLUG

CROSS-REFERENCE TO RELATED APPLICATION

This is a continuation of commonly-assigned U.S. patent application Ser. No. 12/113,377, filed May 1, 2008, now U.S. Pat. No. 7,708,604, which is fully incorporated herein by reference.

BACKGROUND OF THE INVENTION

This invention is directed to a system for constraining an audio plug in an electronic device.

Media players, in particular portable media players, may provide audio to the user using a number of different approaches. For example, the media players may include speakers. As another example, the media players may include communications circuitry for wirelessly providing the audio to an audio output device (e.g., speakers or a headset). As yet another example, the media players may include a connector for receiving a wired audio output device (e.g., wired earbuds or earphones connected to the device using an audio jack). The connector may include several conductive portions (e.g., conductive dimples) extending through the surface of the conductor.

Although wired audio output devices are commonly used, they may be a source of fragility and damage for the audio connector. In particular, because the wired audio output device may include a plug having a first portion extending into the electronic device (e.g., inserted into the audio connector) and a second portion extending out of the electronic device (e.g., extending past the edge of the electronic device), brusque or abrupt movements of the second portion may cause the first portion to move also, thus causing the audio connector to move and perhaps even fail (e.g., by forcing the audio connector to bend inside the electronic device). In addition, if the plug is inserted in the audio connector at an extreme enough angle, the end of the plug may enter a cavity adjacent the conductive portion of the connector and damage the conductive portion.

SUMMARY OF THE INVENTION

A system for constraining an audio plug within an electronic device is provided. In addition, an audio jack with reduced size contacts is provided.

The audio connector may be incorporated in a constraint mechanism, which may include a body that surrounds a tube operative to receive an audio plug (e.g., an audio jack). The end of the tube may include one or more asymmetrical features (e.g., a straight portion or a curved portion) which may correspond to features of an aperture in the electronic device. By providing asymmetrical features, the constraint mechanism may have only one suitable orientation for insertion in the electronic device, thus ensuring other constraining features of the constraint mechanism are properly installed.

The constraint mechanism may include one or more features for preventing a plug inserted in the tube from causing the audio connector to move (e.g., from pitching, yawing, or rolling the audio connector). For example, to prevent yawing, the constraint mechanism may include a center wall extending orthogonally from one surface of the electronic device. The wall may be oriented in the same direction as the tube, and may extend at least half as long as the constraint mechanism body. The electronic device may include a corresponding slot operative to receive the center wall such that substantially all of both sides of the wall abut the edges of the slot. This may prevent the wall, and thus the constraint mechanism, from rotating within the slot (e.g., yawing).

To prevent pitching, the constraint mechanism may include a tab extending from a surface of the body, such that a portion of the tab is offset but parallel to the surface (e.g., creating a void between the constraint mechanism surface and the tab that an electronic device component may engage). If the tab extends from the same surface of the body as the center wall, one or more prongs or used to define the edges of the slot may be operative to engage the tab when the constraint mechanism is inserted in the electronic device. Because the tab is parallel but offset from the surface of the body, attempts to pitch the constraint mechanism will be prevented by the contact between the prongs of the electronic device and the lower surface of the tab and the surface of the body.

To prevent rolling, the electronic device may include a plate extending from a different surface of the body (e.g., a surface adjacent the surface of the center wall and tab). The plate may extend from a plane that includes the centerline of the tube, such that the resistance to the plate can prevent the tube from rolling. The plate may include a hole operative to be aligned with an insert (e.g., a threaded boss insert) of the electronic device when the constraint mechanism is properly positioned in the electronic device. In some embodiments, a mechanical fastener (e.g., a screw or bolt) may be passed through the hole to engage the insert. Then, the plate may abut either the insert or the mechanical fastener when the audio plug attempts to cause the constraint mechanism to roll, thus preventing the audio connector from rolling (e.g., and damaging electrical couplings between the tube and other electronic device components).

The audio connector may include several conductive portions within the tube. For example, the non-conductive tube may include several holes through which conductive dimples operative to contact conductive portions of an audio plug may extend. To prevent the tip of the audio plug from entering one of the several holes, and to prevent foreign particles from passing through one of the several holes and damaging components located behind the tube wall, the size of the holes may match the size of the conductive dimples. In addition, the shape of the holes may be match the shape of the dimples, thus eliminating excess space through which foreign particles may pass.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 1:
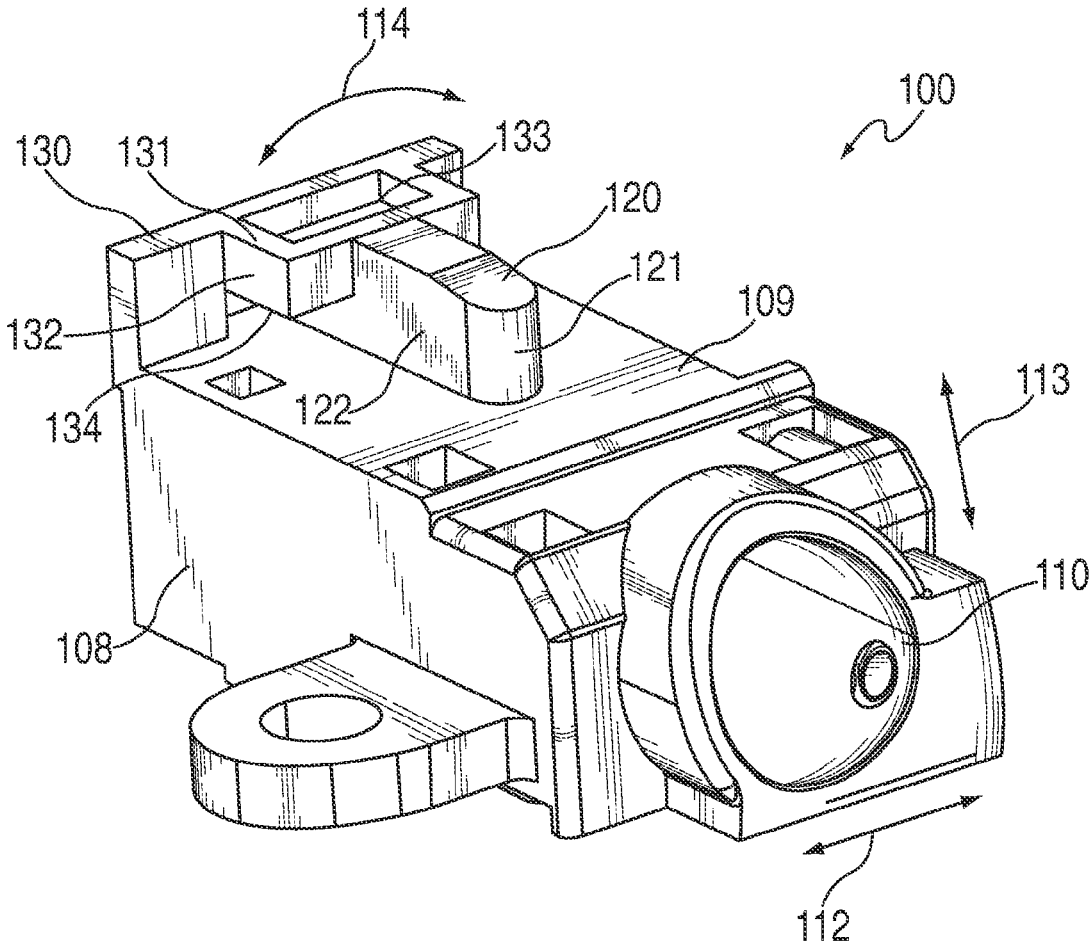
FIG. 1 is a perspective view of an illustrative constraint mechanism for use in an electronic device in accordance with one embodiment of the invention.
Figure 2:
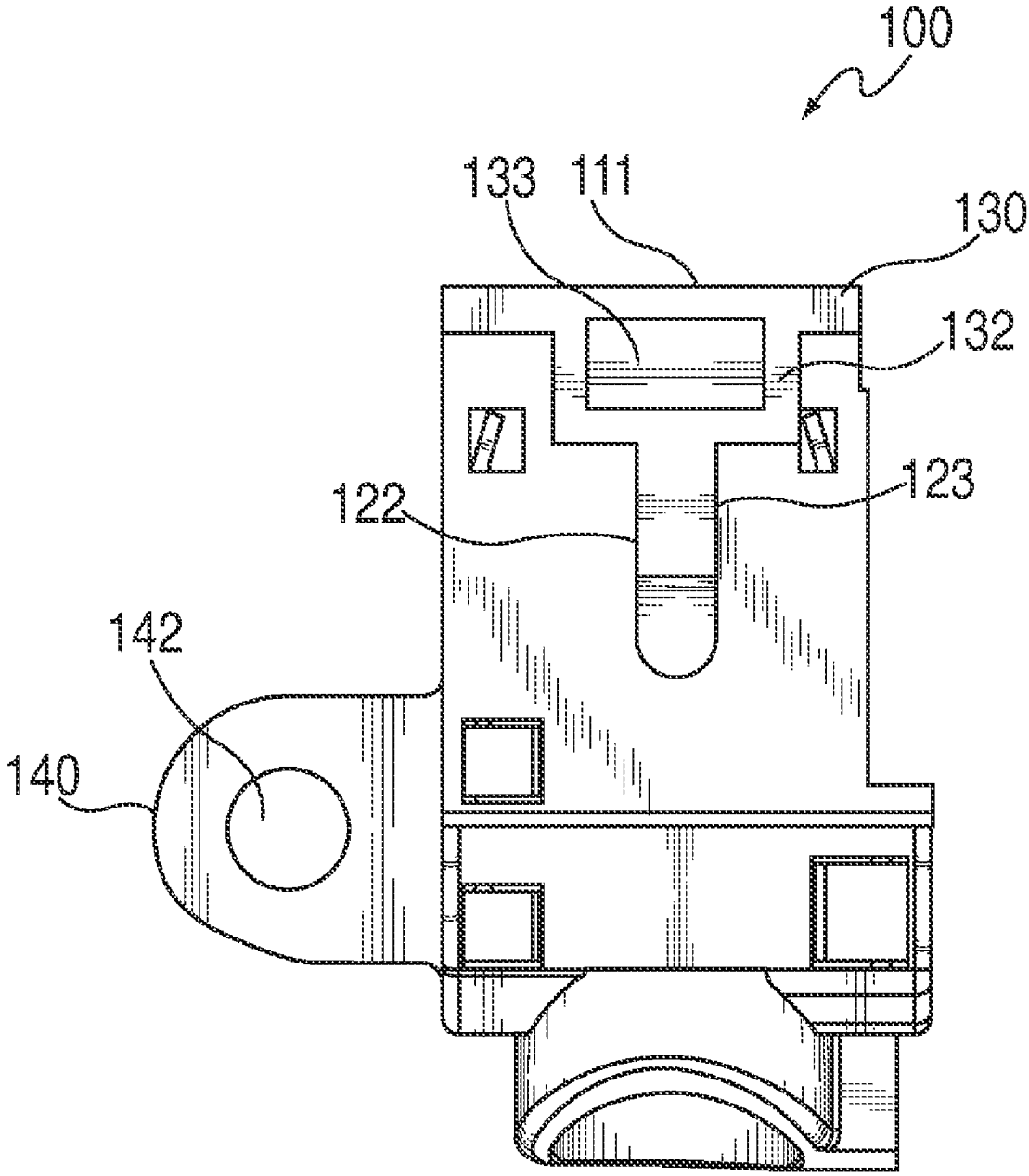
FIG. 2 is a top view of the illustrative constraint mechanism of FIG. 1 in accordance with one embodiment of the invention.
Figure 3:
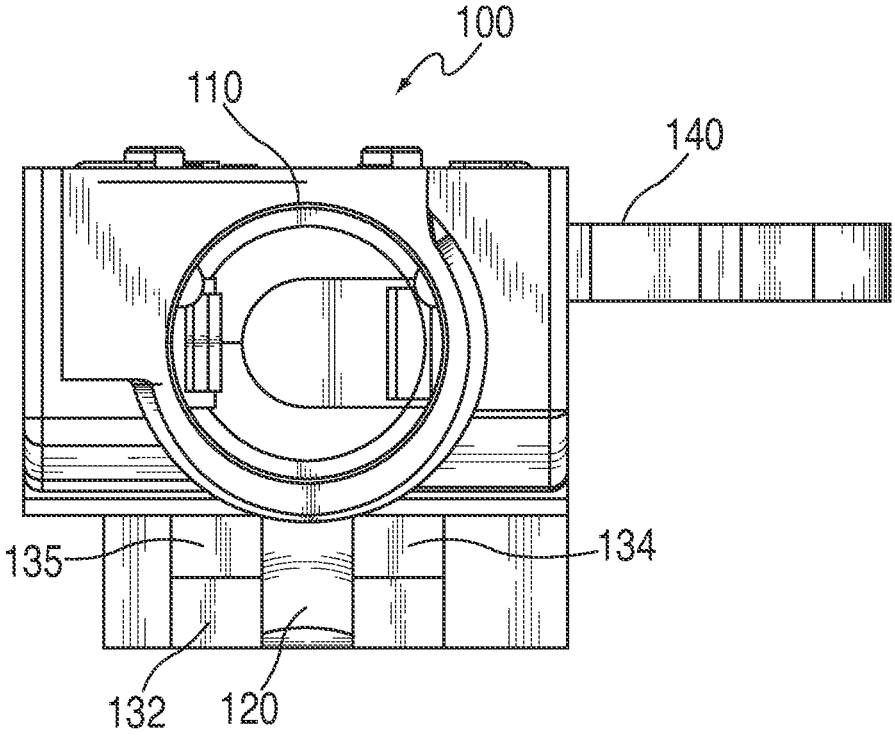
FIG. 3 is a front view of the illustrative constraint mechanism of FIG. 1 in accordance with one embodiment of the invention.
Figure 4:
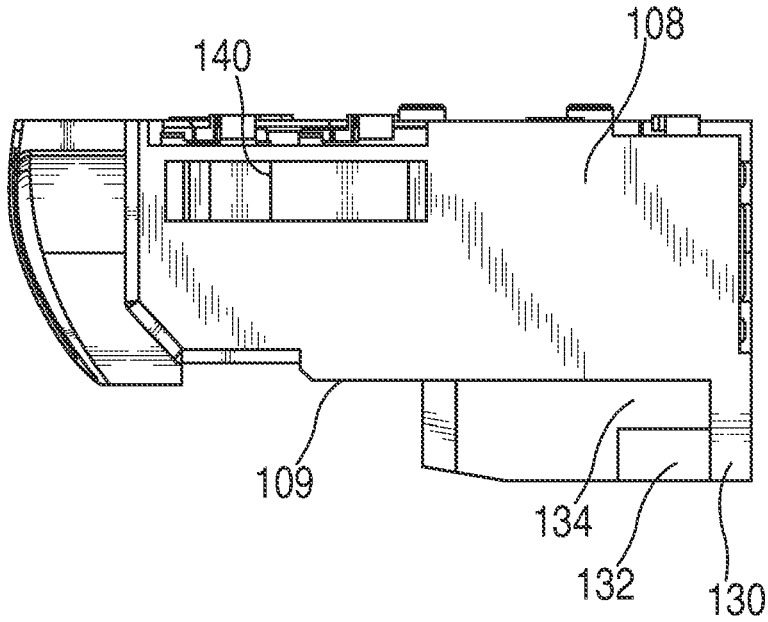
FIG. 4 is a side view of the illustrative constraint mechanism of FIG. 1 in accordance with one embodiment of the invention.

FIG. 1 is a perspective view of an illustrative constraint mechanism for use in an electronic device in accordance with one embodiment of the invention. FIG. 2 is a top view of the illustrative constraint mechanism of FIG. 1 in accordance with one embodiment of the invention. FIG. 3 is a front view of the illustrative constraint mechanism of FIG. 1 in accordance with one embodiment of the invention. FIG. 4 is a side view of the illustrative constraint mechanism of FIG. 1 in accordance with one embodiment of the invention. An audio connector may be embedded in constraint mechanism 100, which may include body 108 having tube 110 for receiving an audio plug (e.g., body 108 may be part of an audio jack for receiving an audio plug). Body 108 may have any suitable shape. For example, body 108 may in part follow the shape of tube 110 (e.g., to minimize the size of body 108). As another example, body 108 may be shaped substantially box-like. As still another example, body 108 may be shaped to support one or more attachment features for coupling body 108 to the electronic device (e.g., body 108 may include thicker portions near the attachment features of constraint mechanism 100).

In some embodiments, body 108 may include one or more electrically conductive portions for coupling electronic device circuitry (e.g. attached to the outer surface of body 108) to electrically conductive portions of tube 110. For example, as discussed in more detail below, tube 110 may include one or more conductive portions (e.g., conductive dimples) extending through the surface of tube 110. Tube 110 may include any suitable number of conductive portions (e.g., 5 portions: left channel, right channel, ground, microphone, and detect). The electrically conductive portions of body 108 may allow the electronic device to receive inputs from an audio output device coupled to the audio plug (e.g., inputs from an in-line switch or switches of an electronic device) and provide the inputs to control circuitry or processors of the electronic device. Similarly, the electrically conductive portions of body 108 may allow the electronic device provide audio signals to the audio output device coupled to the audio plug.

To enable constraint mechanism 100 to resist movements of the audio plug or impacts on the audio plug that are transferred to the tube 110, constraint mechanism 100 may include several restraining features for preventing constraint mechanism 100 from yawing (e.g., in the direction shown by arrows 112), pitching (e.g., in the direction shown by arrows 113), or rolling (e.g., in the direction shown by arrows 114).

To resist yawing, body 108 may include center wall 120 extending from top surface 109 of body 108. Center wall 120 may be oriented in any suitable direction, including for example in the direction of the centerline of tube 110 (e.g., center wall 120 runs along the length of tube 110). In some embodiments, center wall 120 may further be aligned with the centerline of tube 110, or may instead be offset relative the centerline. Center wall 120 may extend from top surface 109 at any angle, including for example orthogonally (e.g., the plane of center wall 120 includes the centerline of tube 110). Leading edge 121 of center wall 120 may be shaped in any suitable manner, including for example have a rounded shape or an angled shape to help direct center wall 120 into a corresponding slot of the electronic device. Center wall 120 may have any suitable length, including for example more than half the length of top surface 109 or of body 108, which may eliminate single contact points around which center wall 120 could rotate. Thus, when inserted in the electronic device, sides 122 and 123 of center wall 120 may abut the sides of the electronic device components defining the slot, thus preventing center wall 120 from rotating (and preventing constraint mechanism 100 from yawing).

To resist pitching, body 108 may include rear wall 130 extending from a surface of body 108 along back surface 111. In the example shown in FIGS. 1-4, rear wall 130 extends in the same direction as center wall 120 (e.g., orthogonal to top surface 109), though it will be understood that rear wall 130 (and tab 132) may extend from any suitable surface of body 108. Rear wall 130 may abut center wall 120 substantially orthogonally (e.g., forming a T-shape). A protrusion 311 may extend orthogonally from rear wall 130 to form tab 132, such that a portion of tab 132 (e.g., protrusion 131) and top surface 109 are substantially parallel. Tab 132 may extend over only a small portion of top surface 109, for example a small section adjacent rear wall 130, and may include one or more holes 133 (e.g., leaving only the frame or boundary of tab 132). Slots 134 and 135 may be created between top surface 109 and tab 132, and bounded by rear wall 130 and sides 122 and 123 of center wall 120. When body 108 is inserted in the electronic device, prongs of the electronic device may extend into slots 134 and 135 such that the prongs are substantially in contact with both top surface 109 and the bottom surface of protrusion 311. Then, if constraint mechanism 100 is pitched (e.g., along arrows 113), the prongs may abut the upper and lower walls of slots 134 and 135, thus preventing constraint mechanism 100 from pitching (e.g., relative the opening of tube 110, which is the point around which constraint mechanism 108 would pivot in response to a force on the audio plug).

To resist rolling, constraint mechanism 100 may include plate 140 extending orthogonally from the side of body 108 (e.g., a side other than top surface 109). Plate 140 may be oriented along the axis of the tube (e.g., and not in a plane of or substantially of the tube opening). Plate 140 may include hole 142 for receiving a mechanical fastener (e.g., a screw or bolt). When constraint mechanism 100 is inserted in the electronic device, plate 140 may rest on a corresponding feature of the device, and be coupled to the feature using the mechanical fastener (e.g., passing a screw through hole 142 and coupling it to the feature of the electronic device), such that attempts to roll body 108 will cause plate 140 to abut against the corresponding feature against the mechanical fastener, and prevent body 108 from rolling. In some embodiments, plate 140 or the constraining elements of plate 140 may be incorporated in center wall 120, or any other suitable plate or wall protruding from the surface of body 108.

Figure 5:
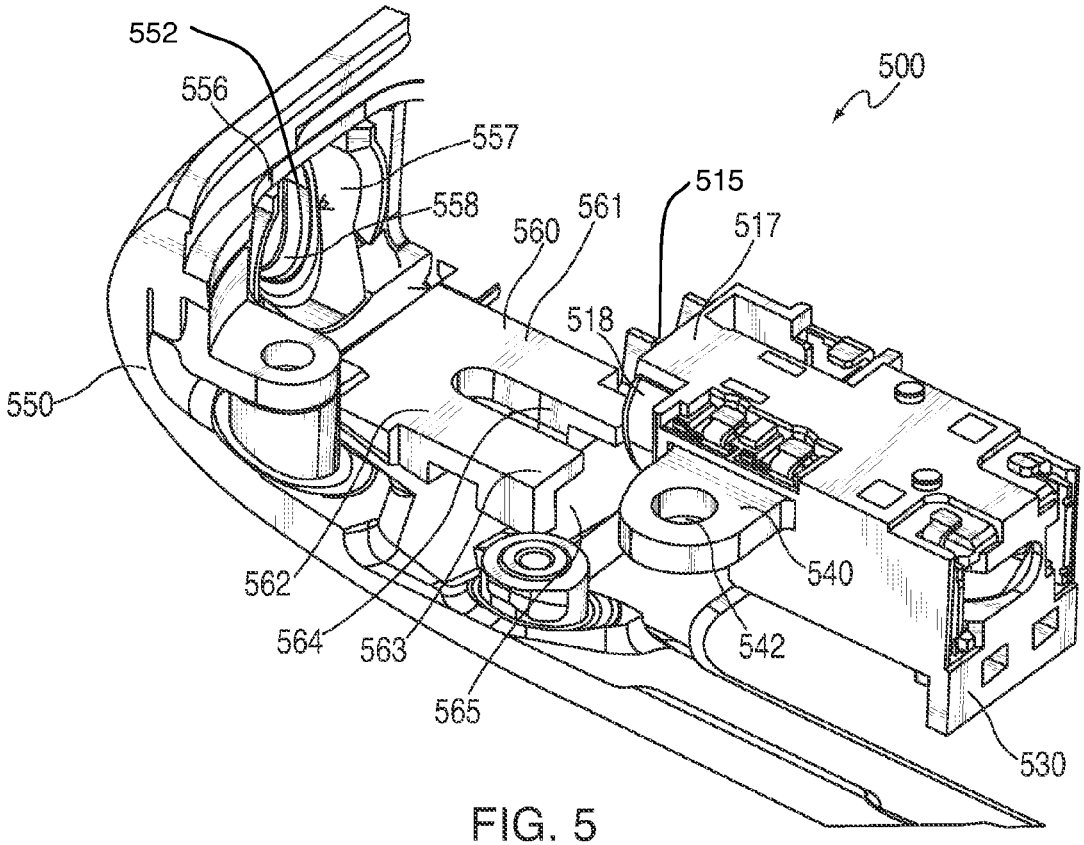
FIGS. 5, 6 and 7 are consecutive perspective views of a constraint mechanism as it is placed in the electronic device in accordance with one embodiment of the invention.
Figure 6:
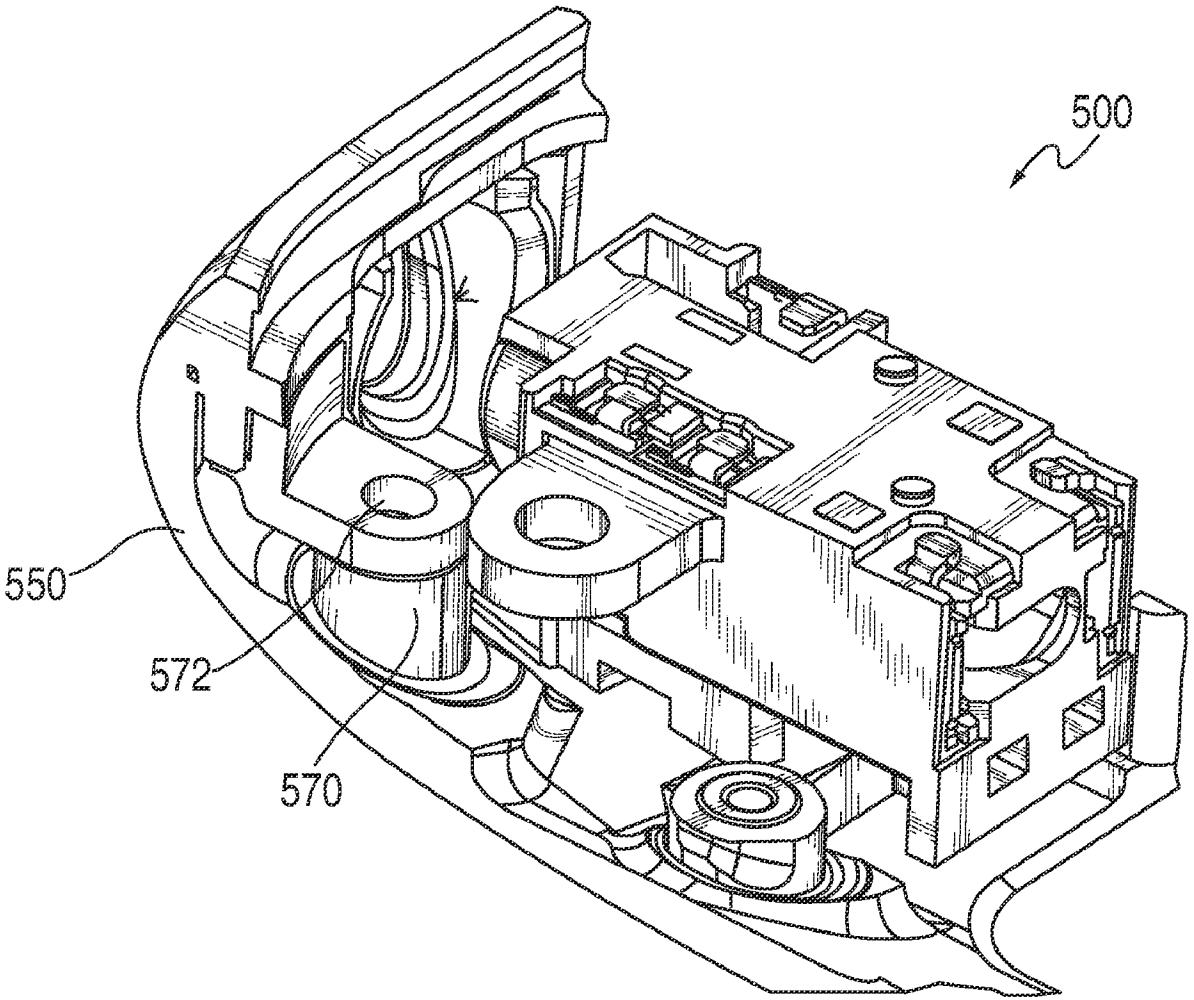
Figure 7:
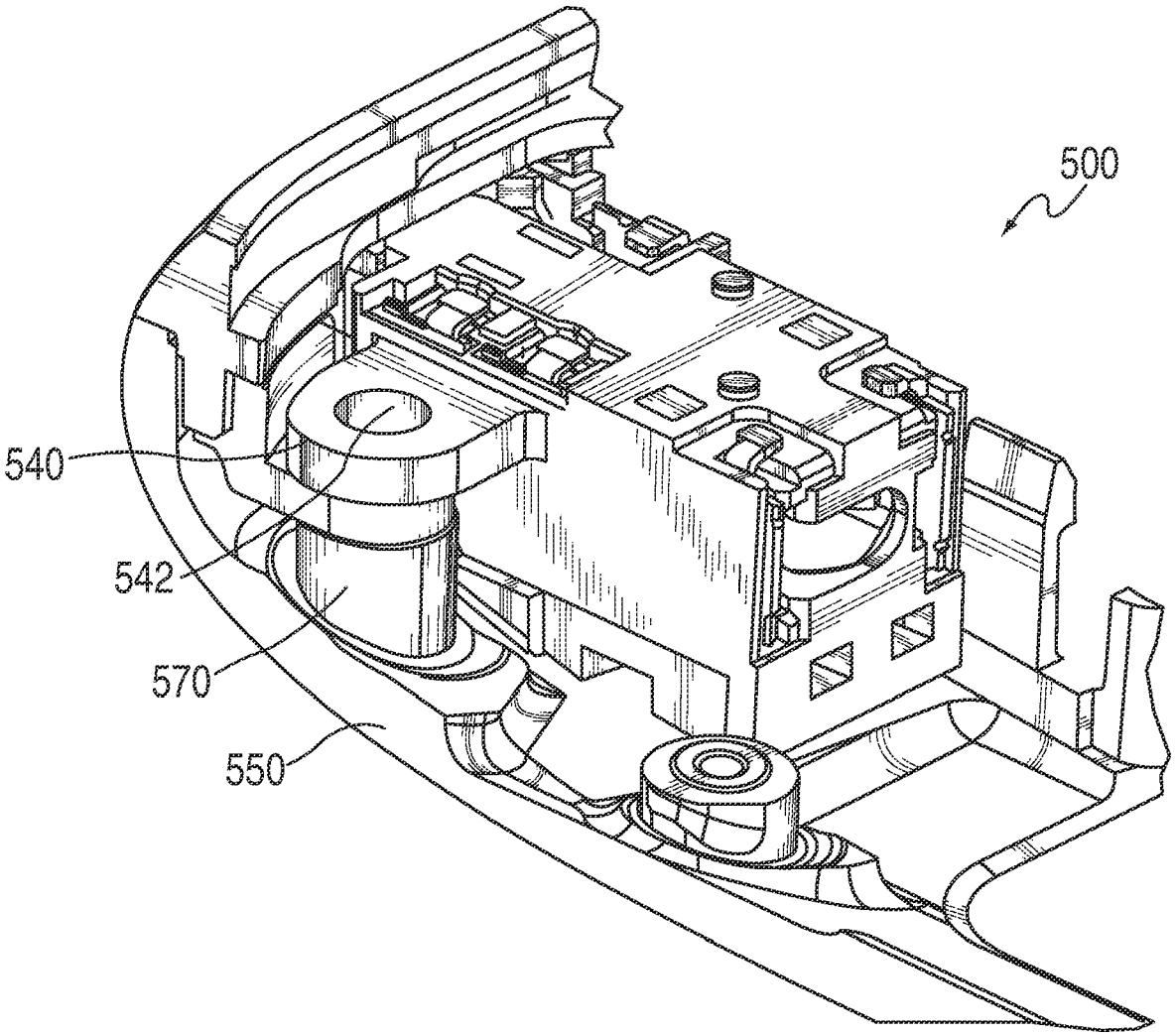
Figure 8:
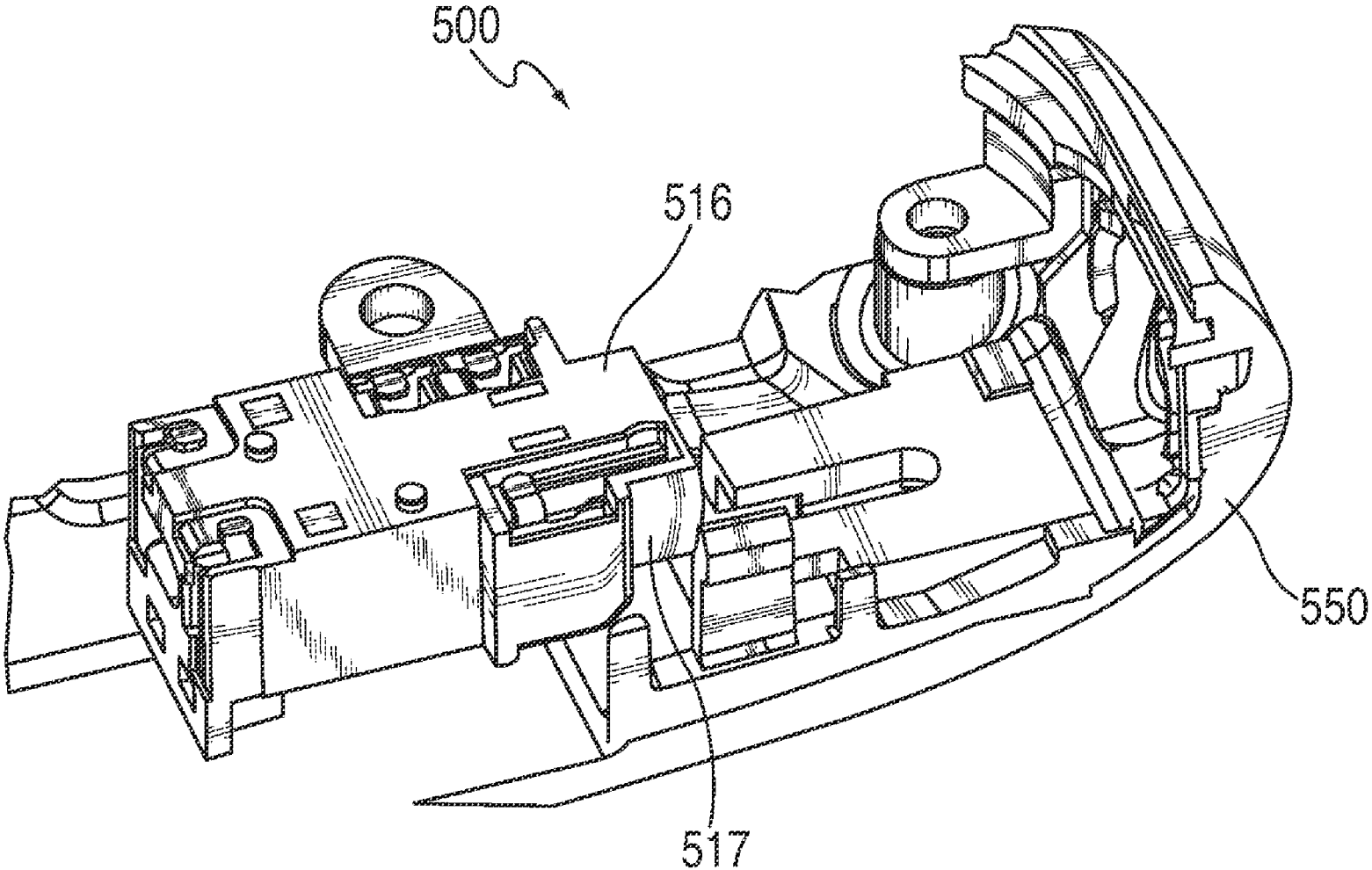
FIGS. 8, 9 and 10 are different consecutive perspective views of the constraint mechanism of FIGS. 5-7 as it is placed in the electronic device in accordance with one embodiment of the invention.
Figure 9:
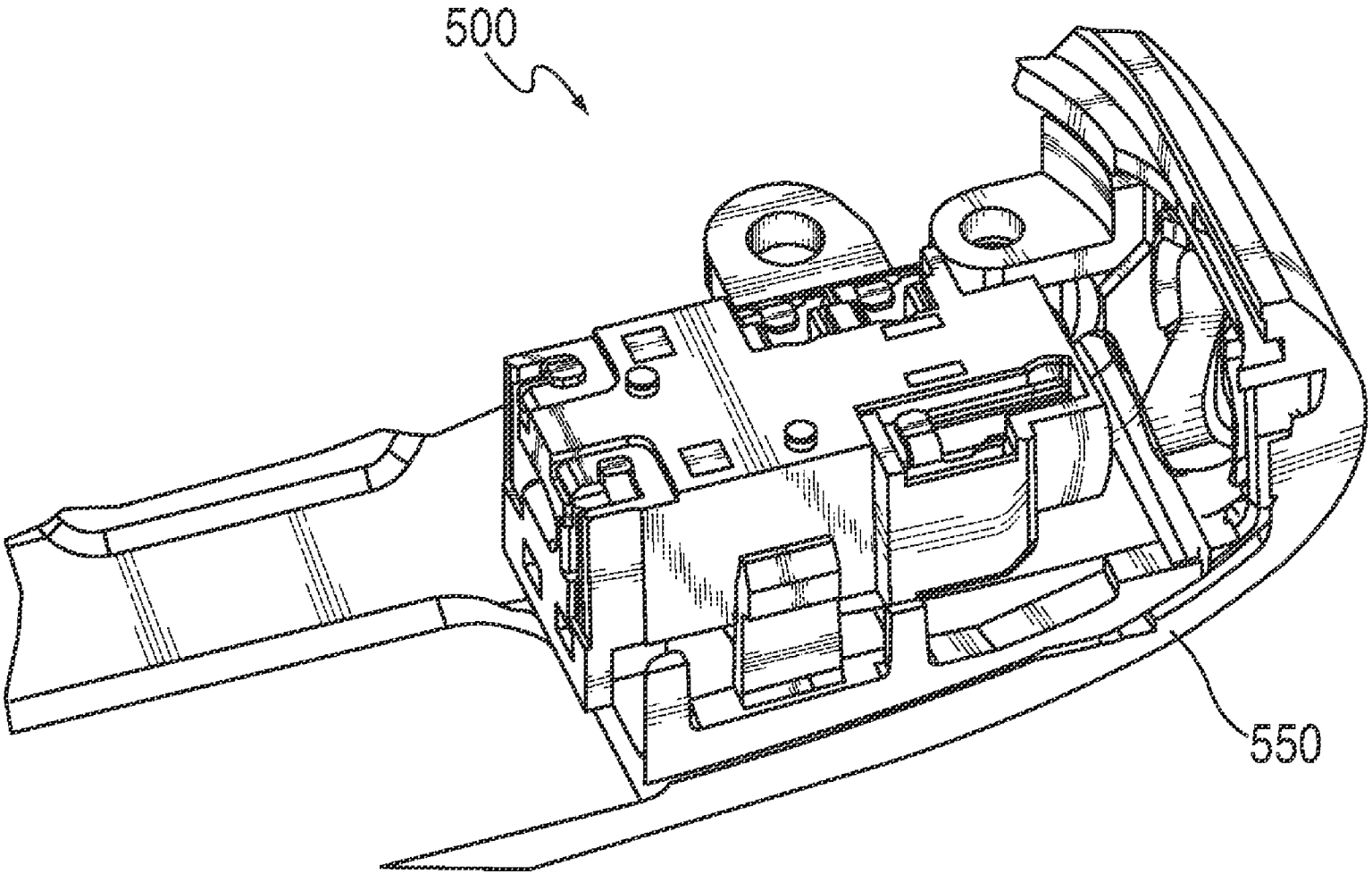
Figure 10:
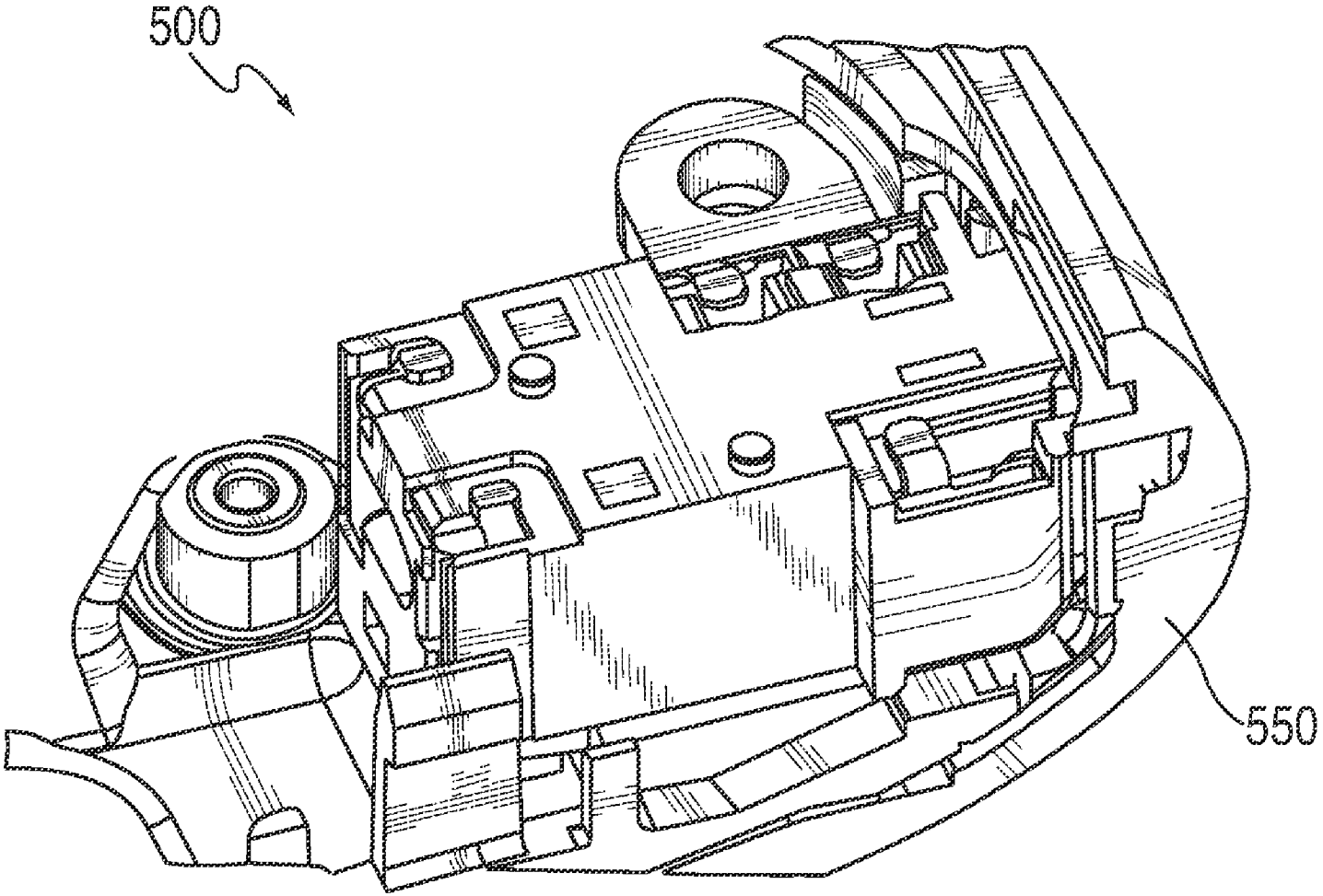

FIGS. 5, 6 and 7 are consecutive perspective views of a constraint mechanism as it is placed in the electronic device in accordance with one embodiment of the invention. FIGS. 8, 9 and 10 are different consecutive perspective views of the constraint mechanism of FIGS. 5-7 as it is placed in the electronic device in accordance with one embodiment of the invention. Constraint mechanism 500 may include some or all of the features of constraint mechanism 100 (FIG. 1). Constraint mechanism 500 may be inserted in electronic device 550 (e.g., in a housing of electronic device 550), which may include several features for receiving and constraining constraint mechanism 500. For example, electronic device 550 may include opening 552 for receiving tip 515 of tube 510 (e.g., adjacent the entrance of the tube). The portion of opening 552 that is exposed (e.g., visible to a user) may include an aesthetically pleasing hole trim (e.g., a cosmetic finish adjacent opening 552). To ensure that constraint mechanism 500 is properly aligned in electronic device 550, tip 515 may include one or more alignment features that limit the number of possible orientations of constraint mechanism 550 (e.g., asymmetrical features). For example, tip 515 may include straight portions 516 and 517 (connected at an angle), and round portion 518. Opening 552 may include corresponding straight portions 556 and 557, and round portion 558 for receiving tip 515. Straight portion 516 and 517, and round portion 518 may be distributed along tip 515 in any suitable manner to ensure that only one orientation of constraint mechanism 500 allows constraint mechanism 500 to extend into electronic device 550.

Electronic device 550 may include prongs 560 and 562 for receiving a center wall of constraint mechanism 500 (e.g., center wall 120, FIG. 2). Prongs 560 and 562 may extend from the surface of electronic device 500, leaving slot 564 into which the center wall may fit. Prongs 560 and 562 may be spaced such that the sides of the center wall abut each of prongs 560 and 562. As constraint mechanism 500 progressively engages electronic device 550, the center wall advances in slot 564 until the leading edge of the center wall reaches the end of slot 564 and tip 515 is fully inserted in opening 552.

In some embodiments, prongs 560 and 562 may not be solid walls, but may instead include free space 565 under top surfaces 561 and 563 of prongs 560 and 562, respectively (thus forming tabs extending over the surface of electronic device 550). Prongs 560 and 562 may be sized such that free space 565 is operative to receive at least a portion of a tab coupled to the center wall (e.g., protrusion 131 of tab 132, FIG. 1), and such that prongs 560 and 562 may be received in slots of constraint mechanism 500 (e.g., slots 134 and 135, FIG. 1). Thus, prongs 560 and 562 may be used to prevent constraint mechanism from pitching or yawing.

Electronic device 500 may include any suitable mechanism for coupling plate 540 to the electronic device. For example, electronic device 500 may include a threaded boss insert (e.g., insert 570) that includes hole 572 to be aligned with hole 542 of coupling plate 540 when constraint mechanism 500 is fully inserted in electronic device 500 (e.g., as shown in FIG. 7). A mechanical fastener may be used to couple plate 540 to insert 570 by passing the mechanical fastener through hole 542 and into hole 572. For example, insert 570 may include threads for engaging a threaded mechanical fastener (e.g., a screw or a bolt). As another example, hole 572 may be smaller than the mechanical fastener to create an interference fit. As still another example, one of insert 570 and the mechanical fastener can be heated to create a heat-seal, or can include an adhesive or other coupling mechanism. Once plate 540 and insert 570 have been coupled, constraint mechanism 500 may be prevented from rolling, thus protecting electronic device 550 from damage that could otherwise be caused by moving an audio plug inserted in constraint mechanism 500.

Figure 11:
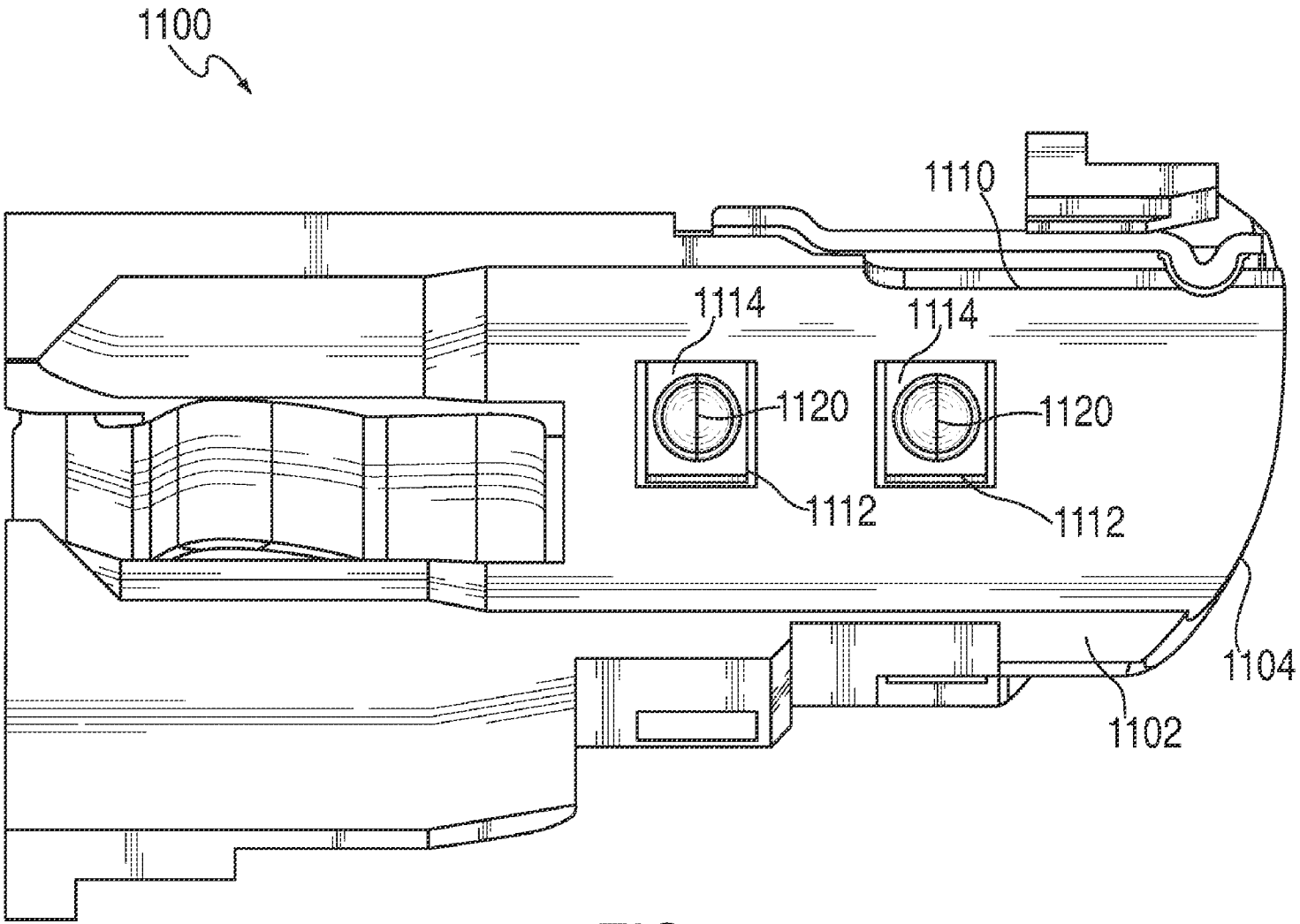
FIG. 11 is a cross-sectional view of an audio connector in accordance with one embodiment of the invention.

FIG. 11 is a cross-sectional view of an audio connector in accordance with one embodiment of the invention. Audio connector 1100 may be inserted in electronic device 1102, such that opening 1104 in electronic device 1102 permits an audio plug to be placed in tube 1110. Tube 1110 may be constructed from non-conductive material, but include apertures 1112 through which conductive material (e.g., conductive dimples 1120) may protrude and come into contact with an audio plug inserted in audio connector 1100. For ease of manufacturing, apertures 1112 and dimples 1120 may have different shapes. For example, apertures 1112 may be substantially square, and dimples 1120 may be substantially round or spherical. In addition, apertures 1112 may be larger than dimples 1120, leaving free space 1114 between the edges of aperture 1112 and dimples 1120. Because at least one aperture 1112 may be located near opening 1104, an audio plug inserted at an extreme angle may be forced into aperture 1112, which may damage dimple 1120. Also, foreign particles may pass between tube 1110 and dimple 1120 through free space 1114, which may damage audio connector 1100.

Figure 12:
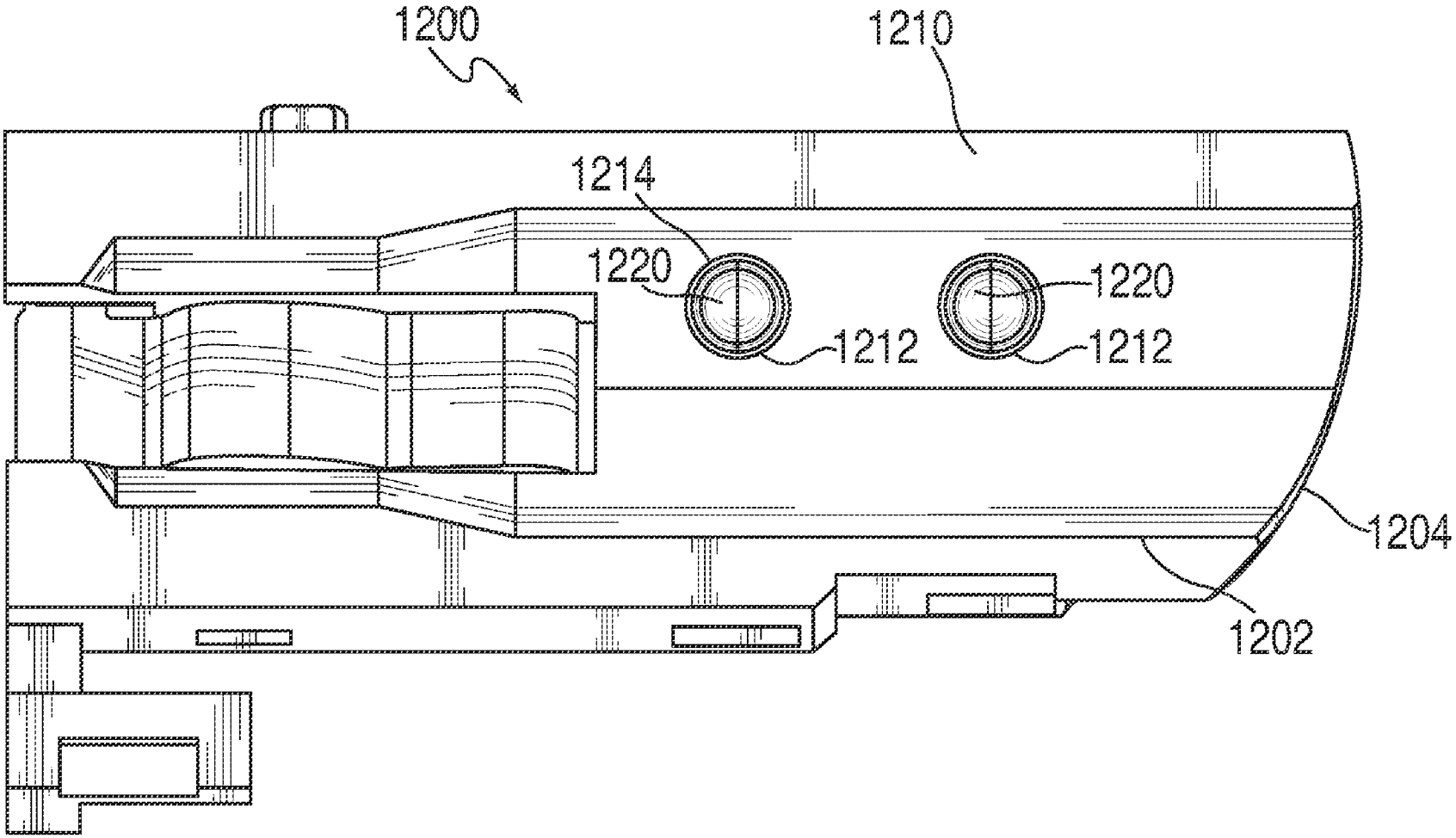
FIG. 12 is a cross-sectional view of another audio connector in accordance with one embodiment of the invention.

FIG. 12 is a cross-sectional view of another audio connector in accordance with one embodiment of the invention. Similar to audio connector 1100, audio connector 1200 may be inserted in electronic device 1202, such that opening 1204 in electronic device 1102 permits an audio plug to be placed in tube 1210. Tube 1210 may be constructed from non-conductive material, but include apertures 1212 through which conductive dimples 1220 may protrude and come into contact with an audio plug inserted in audio connector 1200. Different from audio connector 1100, apertures 1212 and dimples 1220 may be designed and manufactured such that they have substantially the same shape and dimensions. For example, dimples 1220 may be substantially circular, and apertures 1212 may be circular holes having as diameter substantially the same diameter as dimples 1220. By sizing apertures 1212 based on dimples 1220, free space 1214 between the periphery of apertures 1212 and dimples 1220 may be minimized, or even eliminated. Then, even if foreign particles are inserted in tube 1210, or even if an audio plug is inserted in tube 1210 at an extreme angle, the lack of free space 1214 may reduce or eliminate the risk of damage to dimples 1220 or any other portion of audio connector 1200.

The above described embodiments of the present invention are presented for purposes of illustration and not of limitation, and the present invention is limited only by the claims which follow.

What is claimed is:

1. An audio jack, comprising:

a body comprising an opening defining a tube for receiving an audio plug;

at least one aperture through a surface of the tube, wherein the aperture is substantially circular; and a substantially circular conductive dimple operative to contact the audio plug when the plug is inserted in the tube, the conductive dimple extending through the aperture.

2. The audio jack of claim 1, wherein the conductive dimple is substantially the same size as the at least one aperture.

3. The audio jack of claim 1, further comprising:

at least three apertures; and at least three conductive dimples, wherein each conductive dimple is operative to extend through one of the at least three apertures.

4. The audio jack of claim 1, wherein:

the conductive dimple is biased out of the at least one aperture.

5. The audio jack of claim 1, wherein conductive dimple is operative to contact a conductive region of the plug to provide a conductive path between the dimple and the plug.

6. An audio jack for use in an electronic device, comprising:

a tube operative to receive an audio plug;

an opening in a surface of the tube, the opening comprising no corners; and a dimple operative to extend through the opening into a volume enclosed by the tube, wherein the dimple comprises no corners.

7. The audio jack of claim 6, further comprising:

a cap at one end of the tube.

8. The audio jack of claim 6, wherein the opening comprises a substantially circular opening.

9. The audio jack of claim 8, wherein the dimple comprises a substantially circular shape.

10. The audio jack of claim 9, wherein the opening and the dimple are substantially the same size.

11. The audio jack of claim 6, wherein the tube comprises at least one feature for restraining the movement of the tube within an electronic device.

* * * * *